US005530992A

United States Patent [19]

Baermann

[11] Patent Number: 5,530,992

[45] Date of Patent: Jul. 2, 1996

[54] DOUBLE-SIDED HINGES

[76] Inventor: Eckhard Baermann, Am Branderhof 9, 51429 Bergisch Gladbach, Germany

[21] Appl. No.: 260,480

[22] Filed: Jun. 14, 1994

[30] Foreign Application Priority Data

Aug. 27, 1993 [DE] Germany ..... 43 28 821.9

[51] Int. Cl.[6] ..... E05D 15/50

[52] U.S. Cl. ..... 16/231; 16/DIG. 14; 16/260; 16/271; 49/193; 49/382

[58] Field of Search ..... 16/254, 266, 271, 16/272, 320, 357, 360, 231, 232, 265, 260, DIG. 14; 49/193, 382

[56] References Cited

U.S. PATENT DOCUMENTS

| | | | |
|---|---|---|---|
| 321,266 | 6/1885 | Whitney | 49/193 |
| 3,717,902 | 2/1973 | Savenije | 16/271 |
| 3,733,749 | 5/1973 | Parera | 49/382 |
| 3,889,419 | 6/1975 | Maleck . | |
| 3,975,793 | 8/1976 | Just | 16/265 |
| 4,084,291 | 4/1978 | Crowe . | |
| 4,132,034 | 1/1979 | Van Siclen . | |
| 4,947,583 | 8/1990 | Invi et al. . | |
| 5,008,975 | 4/1991 | Wang et al. | 16/254 |
| 5,173,992 | 12/1992 | Aihara et al. . | |
| 5,210,906 | 5/1993 | Aihara et al. . | |

FOREIGN PATENT DOCUMENTS

| | | | |
|---|---|---|---|
| 8502647 | 6/1985 | European Pat. Off. | 49/193 |
| 3111595 | 10/1982 | Germany | 49/382 |
| 881716 | 11/1961 | United Kingdom | 16/231 |

*Primary Examiner*—M. Rachuba
*Assistant Examiner*—Donald M. Gurley
*Attorney, Agent, or Firm*—Vickers, Daniels & Young

[57] ABSTRACT

A hinge is described for use along each side of a refrigerator or on furniture to permit safe opening of the door or lid from either side. The hinge is uncomplicated in design, and is comprised of only a few component parts. Each hinge includes a hinge rod forming a swivel axis for the door, said rod held in an axle take-up receiver. At least one and preferably two interlocks are located at or near the top and bottom of each hinge rod. The interlocks comprise a hinge pick-up axially aligned with the swivel axis of the hinge and a hinge element which becomes mechanically coupled to the pick-up when the door is opened in the other direction. Details of the embodiments of the hinge are disclosed. Preferably, magnetic means are used to keep the hinge rod engaged with the swivel axis and to form the airtight seal between the door and the cabinet.

9 Claims, 8 Drawing Sheets

FIG. 5A
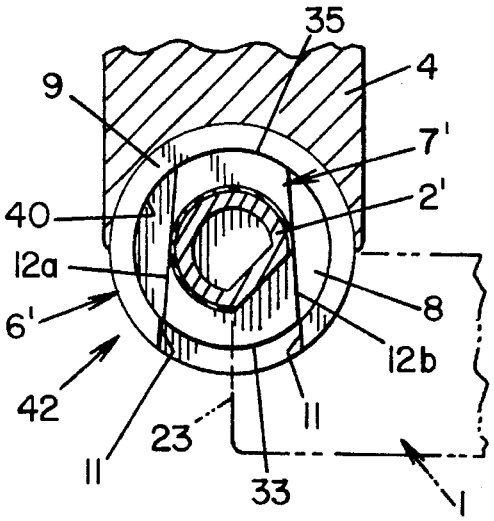
FIG. 5B
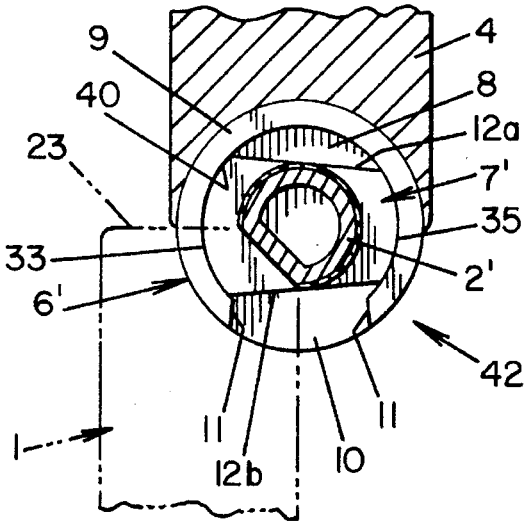
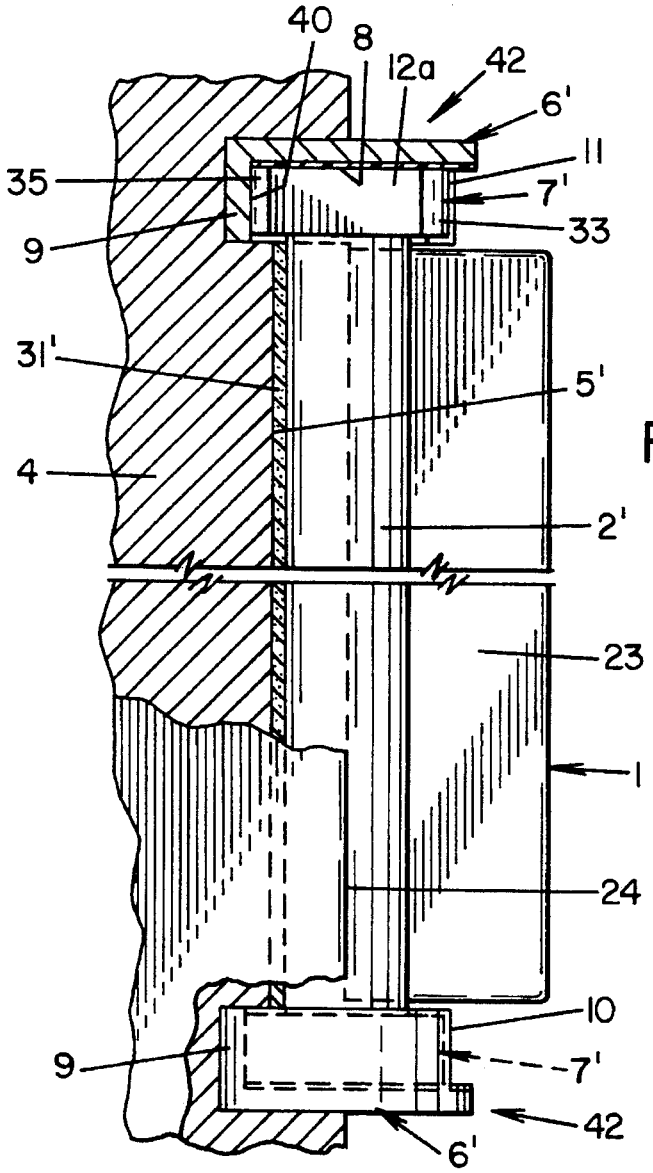
FIG. 6

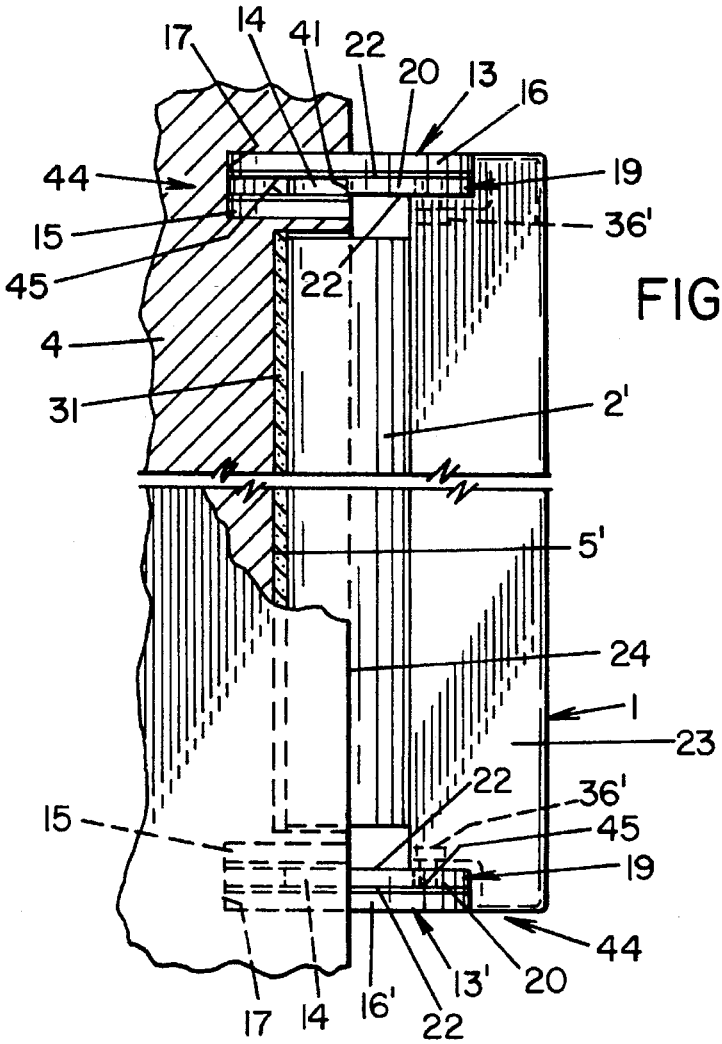
FIG. 11
FIG. 12A
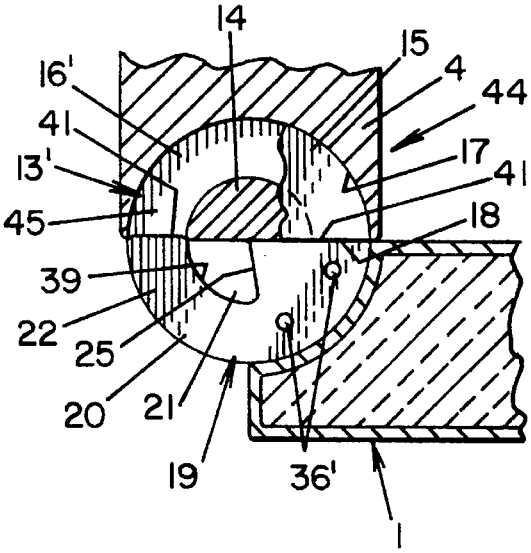
FIG. 12B
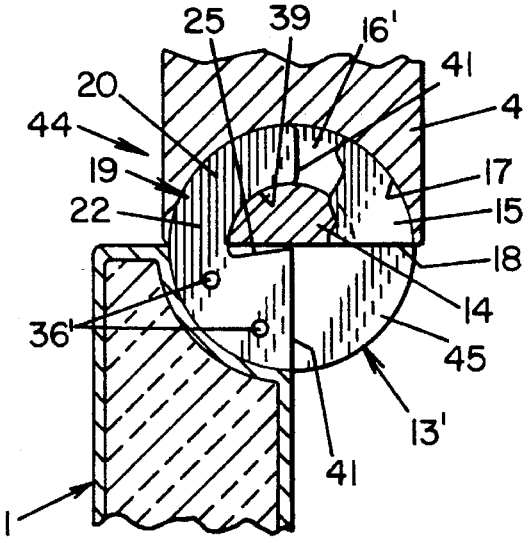

DOUBLE-SIDED HINGES

FIELD OF THE INVENTION

This invention relates to a double-sided hinge for either left or right side opening of doors or lids of furniture or the like, and more particularly the invention relates to the use of double sided hinges on refrigerator doors.

The invention pertains to pairs of hinges that feature the ability to allow a cabinet door such as a refrigerator door to be opened from either of two sides without the necessity of making mechanical changes in the configuration of either hinge, the door or the cabinet. The invention also relates to a hinge arrangement which in addition to functioning as a hinge, forms an airtight magnetic seal between the door and the frame of the cabinet when the door is closed.

Each hinge consists of a hinge pick-up for each individual swivel or pivot axis located on the right and left side of a door opening where individual hinge elements interlock during movement of the door about a pivot axis, and wherein stops are provided for limiting the opening angle of the door. Such door hinges are particularly suited for refrigerator doors since they enable an independent and easy access to the interior. This means that the refrigerator door can be opened from either the left or right side which could prove to be advantageous, especially if the refrigerator is relocated at a different place in the room or is moved from one location to a different location.

BACKGROUND OF THE INVENTION

Over the years, a number of hinge devices have been developed for the purpose of permitting the opening and closing of the doors of refrigerators and other cabinets from either the left or right side of the cabinet. Early embodiments of this concept enabled a person to select the side of the cabinet that would serve as a pivot axis. Thereafter, unless the hardware were altered, the door would open from that side. When it became necessary to change the hinge side, a screwdriver, wrench and other tools were needed to mechanically transfer the pivot axis from one side to the other.

More recent modifications have utilized a combination of springs and latches to allow the door to be opened alternatively from the left or from the right. An example of such a device is shown in EPO Patent Application W085/02647. This design consists of a double sided removable axle arrangement that permits the door to be opened from one of the two sides. In order to prevent an unintentional opening of the door, a locking mechanism is provided for each axle arrangement. This mechanism has to be released by the user by activating an opening button prior to opening the door. This locking mechanism consists of a multitude of elements which when in the closed position are interlocked. As soon as one of the locking mechanisms is released on one side of the door, the door could then be rotated around the closed axle arrangement whereby a cam slides into a curved guide while at the same time the central opening in the door area of the locking mechanism blocks and the release button is locked. This hinge design, however, requires a variety of individual components, causing its production and adjustment to be time consuming and expensive.

If such a hinge design is used for a refrigerator door consumers will have to change their habits with regard to opening the door. Such doors are commonly equipped with a magnetic lock, in other words the door is opened by overcoming the magnetic forces without any further actions being necessary. With the already known solution, however, the locking mechanism would have to be released prior to opening the refrigerator door, and then afterwards the door could be opened by overcoming the magnetic holding forces. In case such refrigerators are used by public institutions or in hotels then an instruction manual for opening the door would have to accompany each and every refrigerator which naturally could prove to be quite bothersome.

SUMMARY OF THE INVENTION

The deficiencies of the prior art are overcome by the present invention which comprises a cabinet having a frame defining an opening, a generally rectangular hinged door closing said opening and hinged closure means on two opposing sides of said door. The closure means on one side is coupled to the cabinet frame when the door is opened from the other side. The improvement consists of the use of hinges containing a safety interlock including a) hinge elements spaced from one another and axially aligned with the pivot axis of the door when in the closed position, and b) a pick-up to receive each of said hinge elements when the door is opened about the pivot axis passing through the hinge pick-up.

As a further embodiment, each hinge also includes a hinge rod between the hinge interlocks along each side of the door and integral with the hinge interlocks, the hinge rods pivotally engaging corresponding receivers or axle pick-ups to provide a pivot axis in line with the axis of the interlocks. The hinge rods are preferably retained in the receiver by magnetic attraction. This may be achieved by lining the receiver with a thin magnetic foil such as a flexible magnetic strip of oriented magnetic particles in a matrix of a flexible binder. Alternatively, the receiver or the rod may be magnetic, with the other component being made from, or containing a magnetically attractive material.

More specifically, the invention relates to a hinge unit for use along one side of a double-hinged cabinet door. The hinge unit comprises a first portion composed of an elongated pivot means in the door magnetically engaging a receiver mounted in the frame of a cabinet and providing an air seal along the first hinged side of the cabinet when the door is closed. The hinge unit also includes one and preferably at least two interlocks longitudinally spaced along said elongated pivot means. Each interlock comprises a hinge element adapted to be mounted on the door and a pick-up adapted to be mounted on the cabinet. The hinge element rotates into interlocking engagement with said pick-up as said door is rotated about the pivot axis. The hinge element is removable from said pick-up as the door is rotated about the axis of a second hinge unit mounted on the opposite side of the cabinet and the door. The receiver comprises an elongated semi-circular axle take up and the pivot means comprises a hinge rod rotatable within said axle take-up. The portion of the hinge that rotates within the axle take-up is circular in cross section.

In one embodiment of the safety interlock, each pick-up comprises a cylinder open at one end and closed at the other, the wall of the cylinder having an interior and exterior surface. The cylindrical wall has an inlet therethrough adapted to receive the hinge element. Typically, one cylindrical pick-up is mounted in the cabinet at the top and one at the bottom of the receiver, in axial alignment with the swivel axis of the hinge. The open ends of the cylinders face one another and the inlets through the cylindrical walls are aligned with the elongated opening of the receiver. Each hinge element is a disk generally in the shape of a truncated pie. It contains a pair of planar surfaces connecting first and second curved surfaces, the radius of each conforming to the radius of curvature of the interior cylindrical surface of the hinge pick-up. The length of each of the planar surfaces is no greater than the inner diameter of the cylinder to permit rotation of the hinge element within said pick-up. The interlock furthermore includes guide means to guide said hinge element out of and into said pick-up as said door is pivoted about the opposite axis between a door closed position and a door open position.

In another embodiment of the interlock, the hinge element comprises a semi-circular disc containing a recess, and the pick-up includes a semi-circular disc joined to but spaced from a circular disc by a coplanar, semi-cylindrical post. The spacing between the discs is at least equal to the thickness of the hinge element. The discs and the post are in axial alignment with the hinge axis when the door is closed, and the hinge element is in contact with the planar edge of the semi-circular post. The recess in the hinge element has a semi-arcuate shape formed by a straight edge extending into the disc in a direction generally orthogonal thereto for a distance comparable to the radius of the semi-circular post. The surface of the recess then extends back to the planar edge of the disc in a circular curve with the radius of curvature being comparable to the radius of the post. The opening of the recess is sized to receive the post. When the door is opened about the hinge axis, the recess engages the semicircular portion of said post whereby the door becomes mechanically coupled to said cabinet. The straight portion of the recess contacts the planar surface of said post upon opening of the door about the hinge axis thereby limiting the distance that the door can be opened.

It is an objective of the present invention to provide for a double sided hinge that is quite easy and handy to use, that requires only a few components and an uncomplicated design, and that can be produced quite reasonably.

Another objective is a simplified hinge design for use in pairs on both sides of a cabinet such as a refrigerator.

Still another objective is a hinge design including means allowing the opening of a door from one side while interlocking the door to the frame along the opposite side, and forming an air seal when the door is closed, without the need for a separate door gasket along the hinge sides.

Yet another objective is a hinge which combines the advantages of a magnetic air seal with a hinge interlock to permit opening of a door about either of two parallel axes or from within the cabinet if necessary.

BRIEF DESCRIPTION OF THE DRAWINGS

These and other objectives are accomplished in the manner to be hereinafter described in greater detail with particular reference to the drawings in which:

FIG. 5A is a cross sectional view taken along line 5A–5A of FIG. 3 with the door in a closed position;

FIG. 5B is a cross sectional view similar to FIG. 5A with the door in the open position;

FIG. 6 is an elevation view partially in cross section taken along line 6—6 of FIG.3;

FIG. 11 is a partial cutaway view along line 11—11 of FIG. 10;

FIGS. 12A and 12B are cross sectional views taken along line 12—12 of FIG. 10 showing the second embodiment of the hinge interlock with the door in the closed and in the open position;

DETAILED DESCRIPTION OF THE INVENTION

Figure 1:
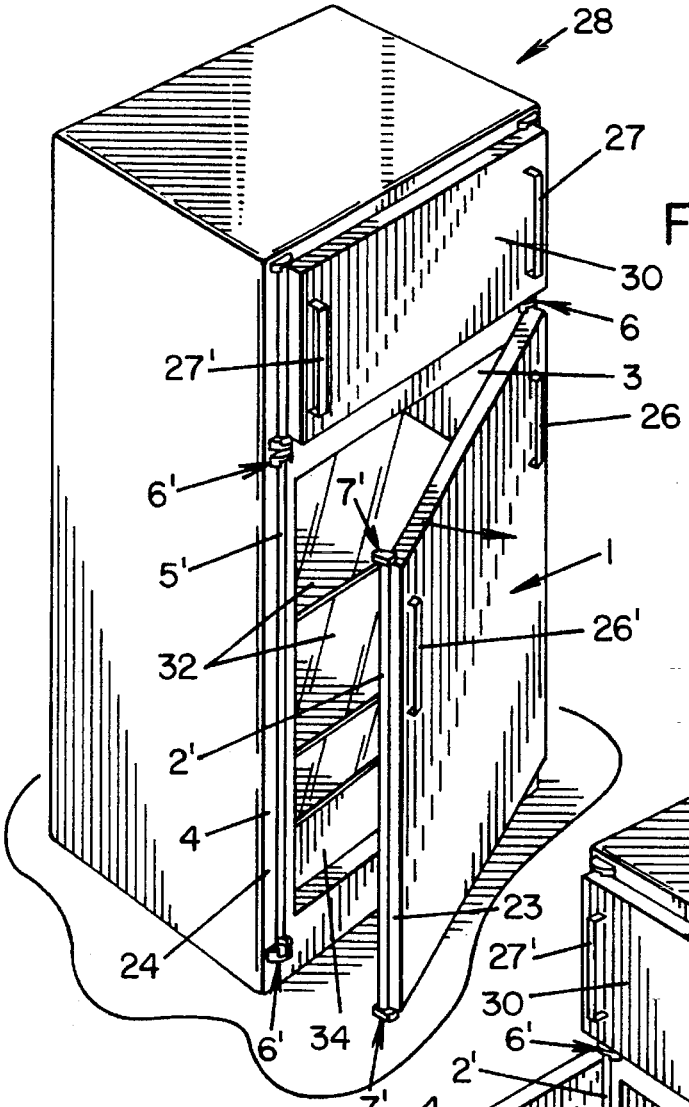
FIG. 1 is a perspective view of a refrigerator with one door open from the left side.
Figure 2:
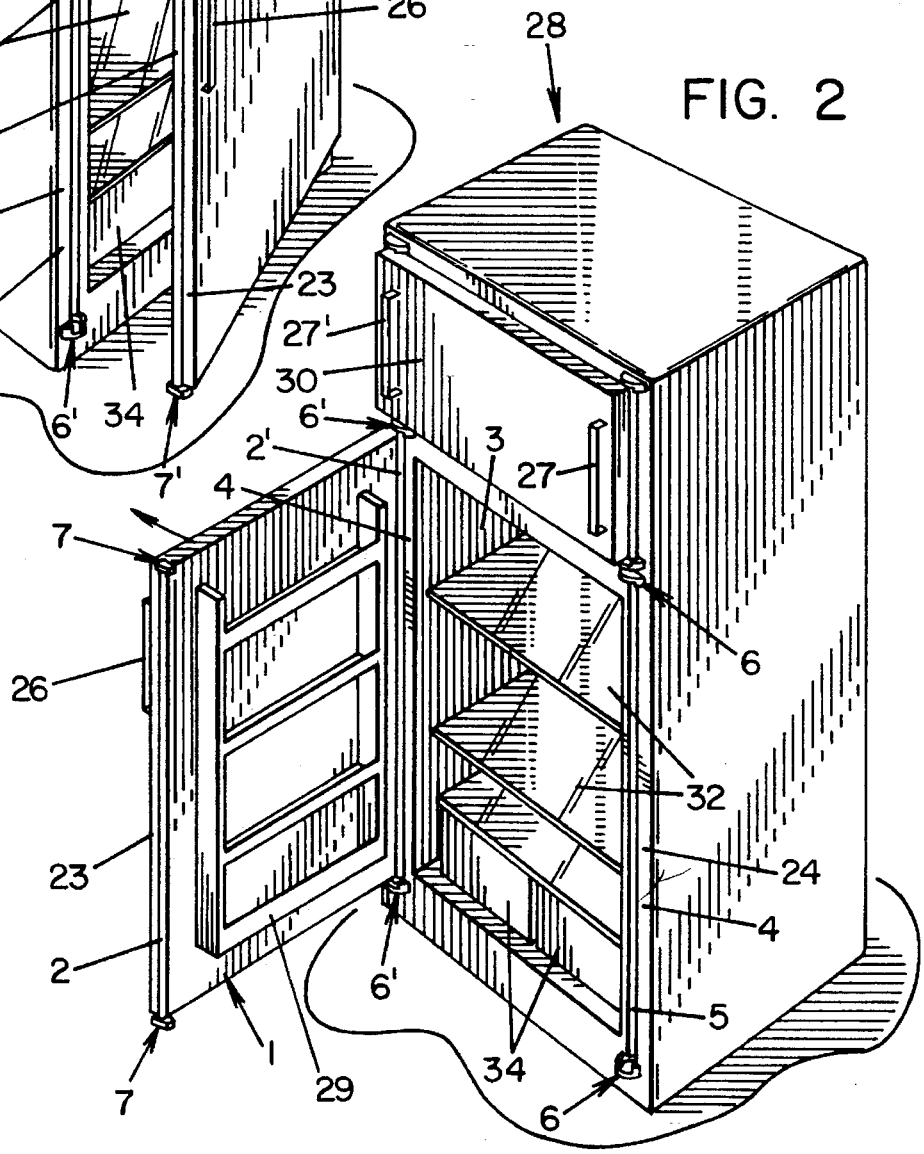
FIG. 2 is a perspective of a refrigerator with a door open from the right side.
Figure 3:
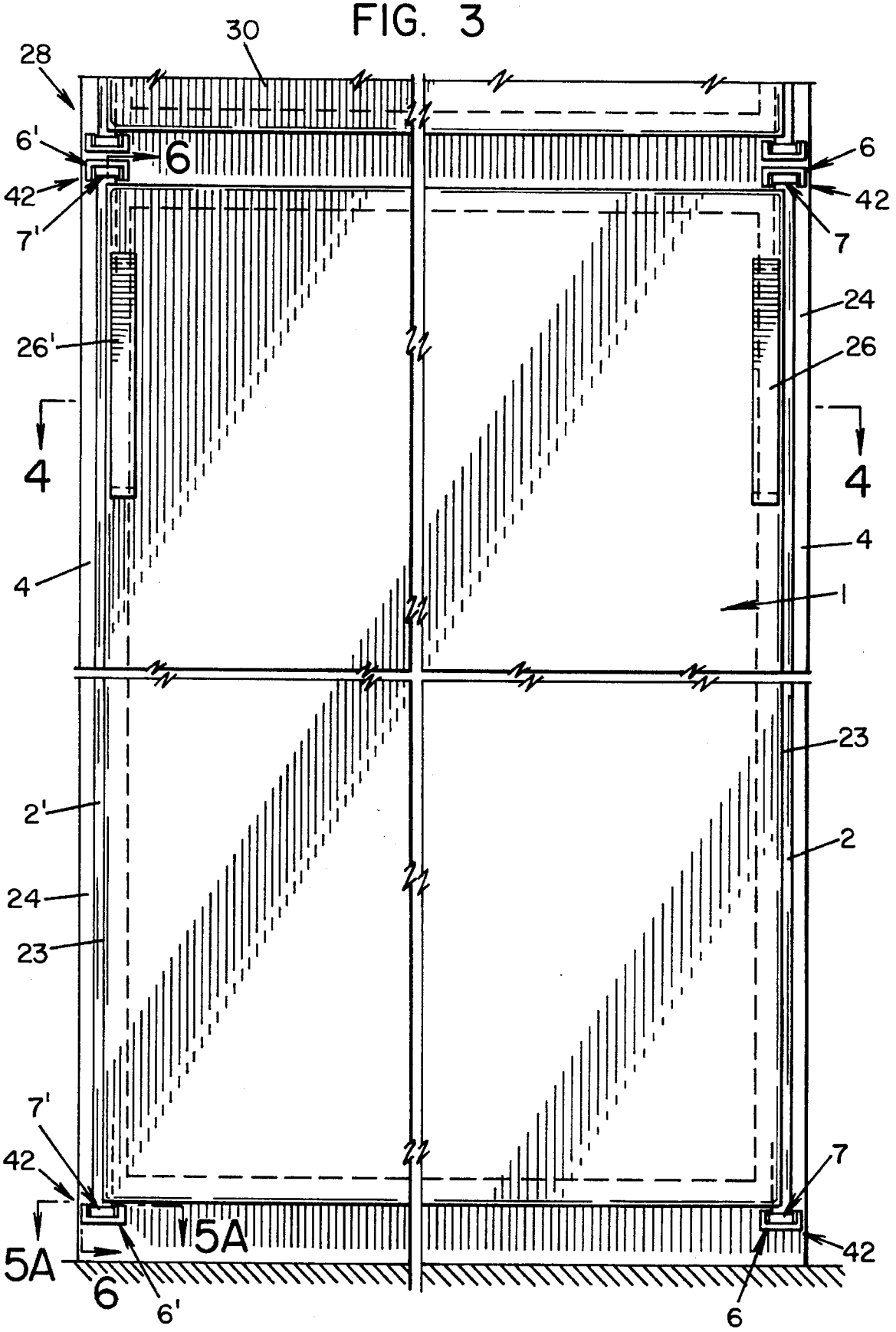
FIG. 3 is an elevational view of a refrigerator door showing one embodiment of the present invention.

Referring now to the drawings, FIGS. 1, 2 and 3 show a refrigerator 28 comprising a top mounted freezer compartment closed by a freezer door 30, and a refrigerator compartment closed by a second door 1. The freezer door has two handles 27, 27'. Likewise the refrigerator door has two handles 26, 26'. The refrigerator compartment is typically provided with shelves 32, drawers 34, and a rack 29 mounted to the door. Hinge units extend along the left and right sides of door 1. Each hinge unit includes hinge rods 2, 2' adapted to engage receivers 5, 5', in the frame of the refrigerator. Hinge elements 7, 7' on the door engage hinge pick-ups 6, 6' mounted in the frame of the refrigerator compartment at the two ends of the receivers. The freezer compartment likewise may utilize two hinge units as well.

Figure 4:
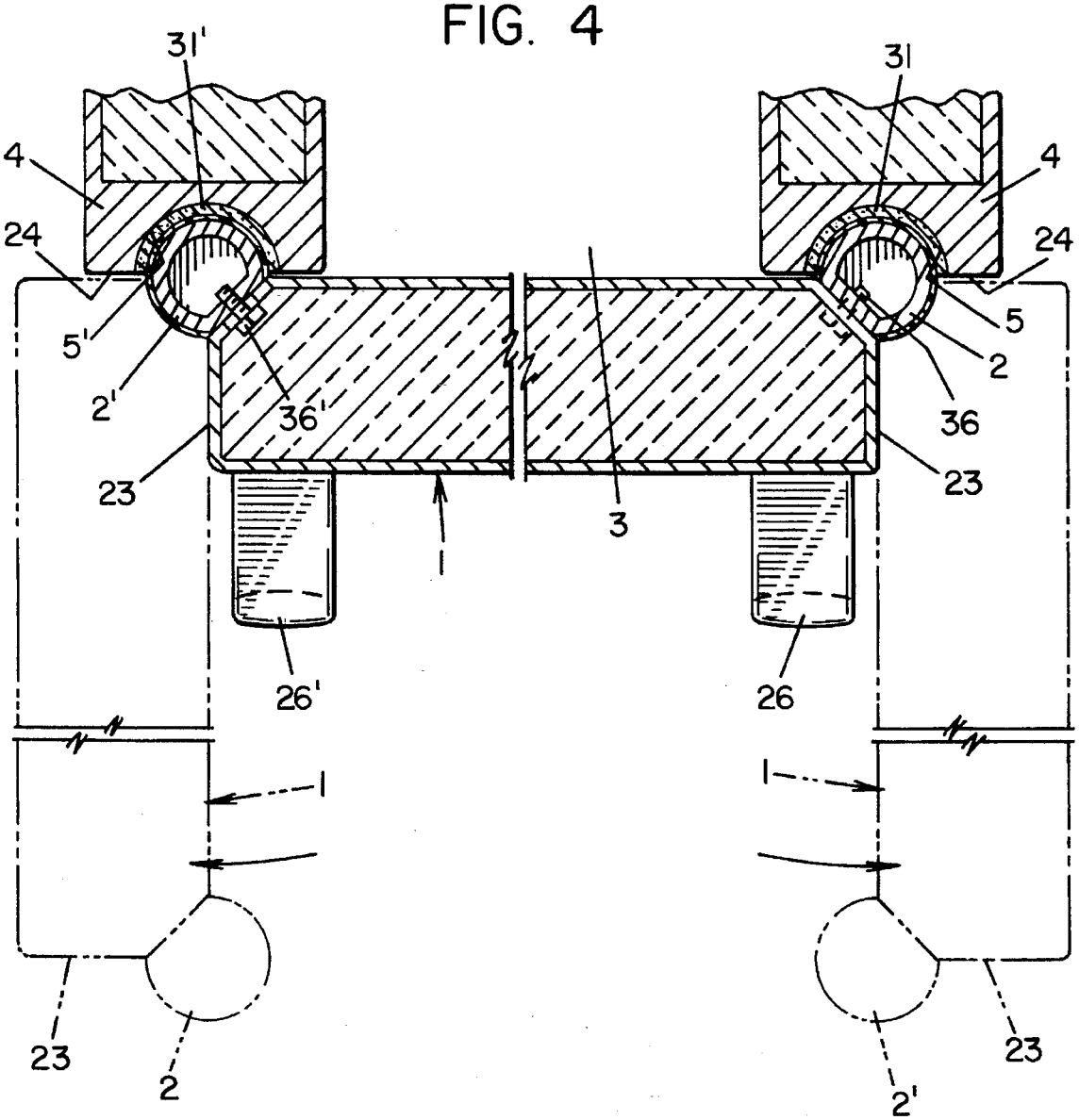
FIG. 4 is a cross sectional view taken along line 4–4 of FIG. 3.

As can be seen in FIG. 4 a hinge rod 2, 2' is provided on both sides of the door 1 inside of an available swivel axis. These hinge rods 2, 2' are permanently connected to the door 1 by suitable fastening means 36, 36' such as threaded bolts, self tapping screws or snap fasteners. The rods have a relatively large diameter as will be explained hereinafter. In order to provide for a turning movement of the door 1 inside a door opening 3, axle take-ups 5, 5' are located inside the appropriate door frame 4, into which the hinge rods 2, 2' can be inserted to form a close fit. These axle take-ups 5, 5' are shaped like elongated semi-cylindrical tubes or troughs which are opened in the direction of the door 1 in order for the axle take-ups 5, 5' to take over the function of the hinge rods 2, 2'. The door-closed connection between the individual hinge rods 2, 2' and the appropriate axle take-ups 5, 5' could be realized with a spring element. However, this could prove to be a disadvantage with regard to permanence and safety. Therefore, the door-closed connection between the hinge rod 2, 2' and the axle take-up 5, 5' preferably is realized with the help of a magnetic force. This would enable a person such as a small child to open the. door from the inside—thereby greatly minimizing the likelihood of the person becoming trapped within the refrigerator. The magnetic force could be created by a partially covered magnetic foil 31, 31' inserted into the interior of the axle take-up 5, 5'. The foil may be prepared from oriented particles of a highly anisotropic material such as iron barium oxide held together in a binder such as polyvinyl chloride. Methods of making such foils are well known in the art as exemplified by the teachings of U.S. Pat. No. 2,959,832 issued Nov. 15, 1960 and entitled "Flexible or Resilient Permanent Magnets" and U.S. Pat. No. 2,965,953 issued Dec. 27, 1960 and entitled "Method of Producing Permanent Magnets".

Another variant would be to make the axle take-up 5, 5' out of a permanently magnetic material and installing the take-up into the door frame 4 as a separate component. Thus, the door-closed connection between the hinge rod 2, 2' and the axle take-up 5, 5' could be realized by very simple means.

In order to achieve an extremely good magnetic linkage, the open radius of the interior of the axle take-up 5, 5' corresponds to the radius of the hinge rod 2, 2'. In case an axle take-up 5, 5' is provided with a magnetic foil, then the radius of the remaining space is adjusted to accommodate the thickness of the foil while accepting hinge rod 2, 2'. In order to achieve sufficient magnetic force to hold the possibly very heavy door i.e., with the rack 29 loaded with jars and cans of food, the diameter of the hinge rods 2, 2' preferably is far greater than those used for standard refrigerators where a pin is normally used as a hinge rod. Rods having a diameter between ½" and 1½" are desirable, although smaller as well as larger diameters are usable as well.

Figure 9:
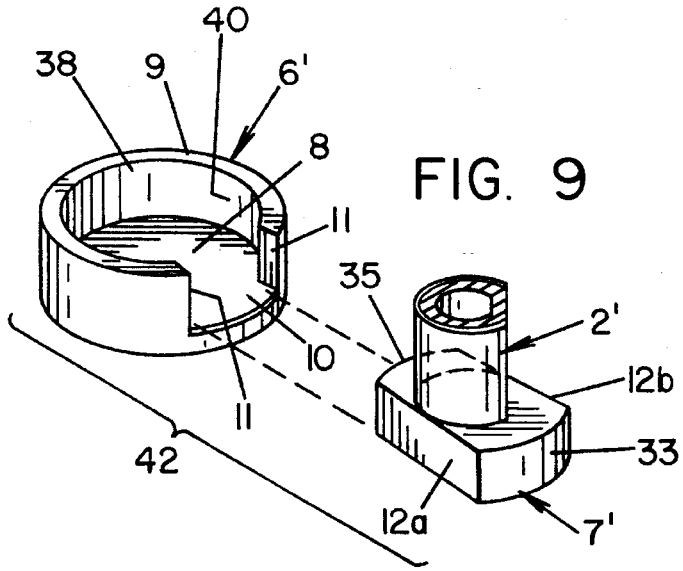
FIG. 9 is an enlarged perspective view showing the disassembled component parts of an interlock of the present invention.
Figure 8:
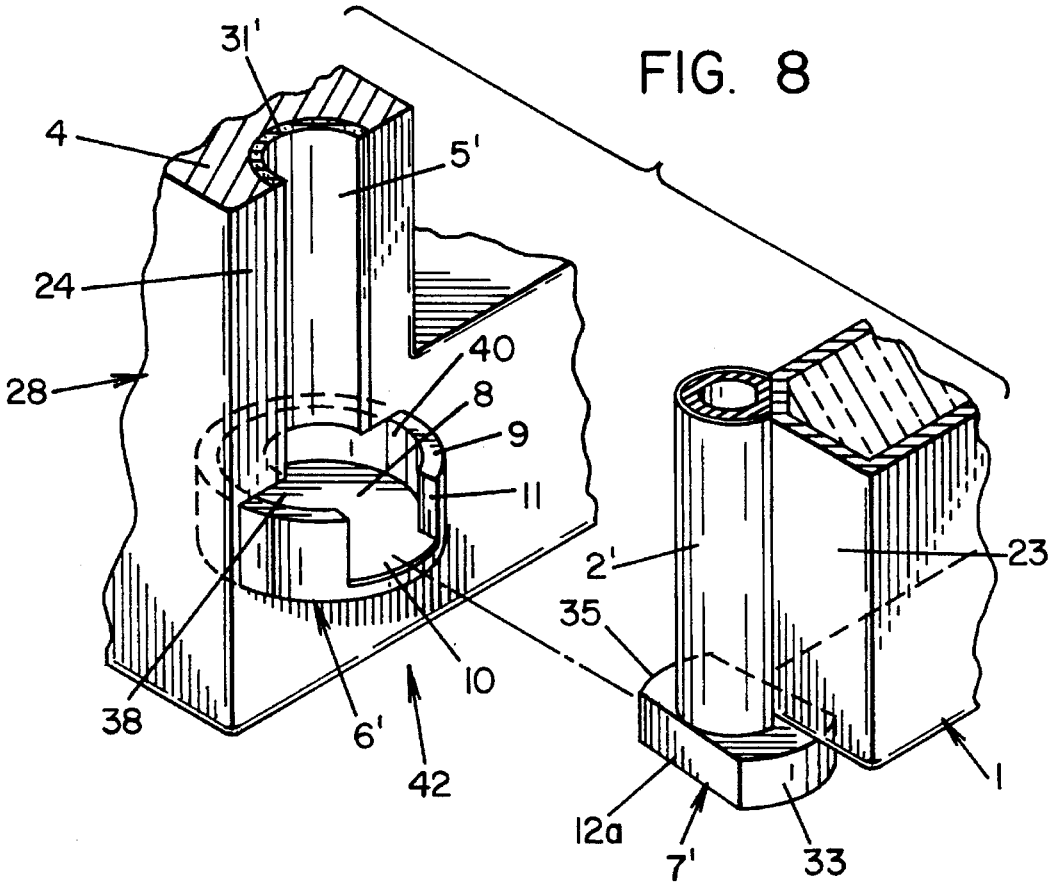
FIG. 8 is an exploded perspective view of a portion of a door and cabinet, showing the components of the present invention installed therein.
Figure 10:
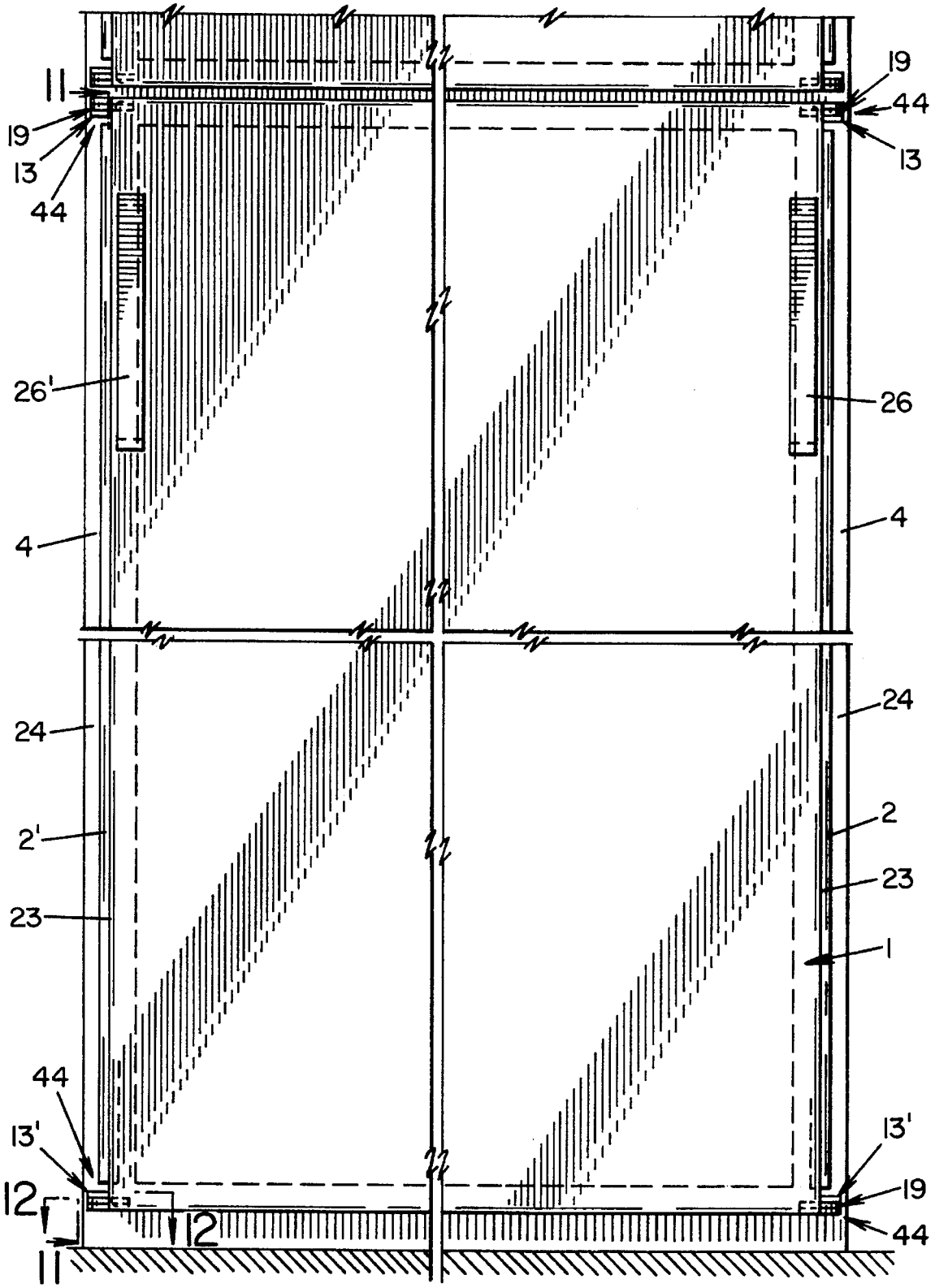
FIG. 10 is an elevational view of a door similar to FIG. 3 showing a second embodiment of the present invention.
Figure 14:
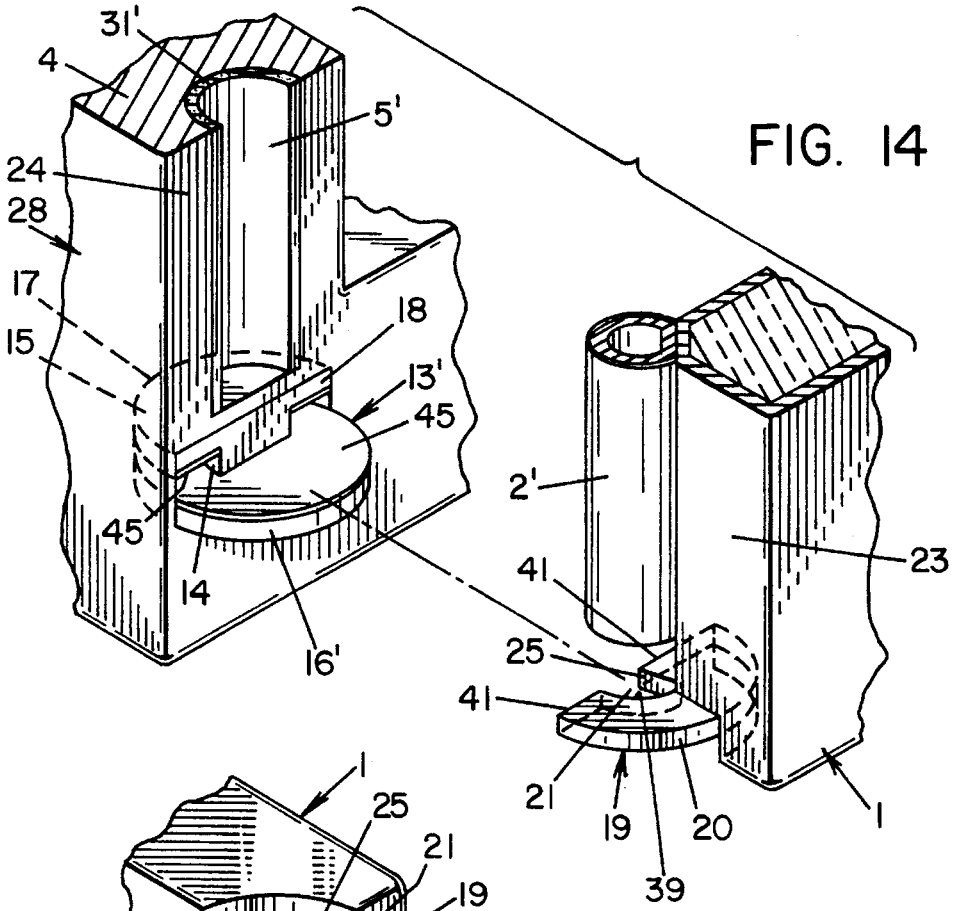
FIG. 14 is an exploded perspective view of a second embodiment of the hinge interlock and the hinge of the present invention.
Figure 13:
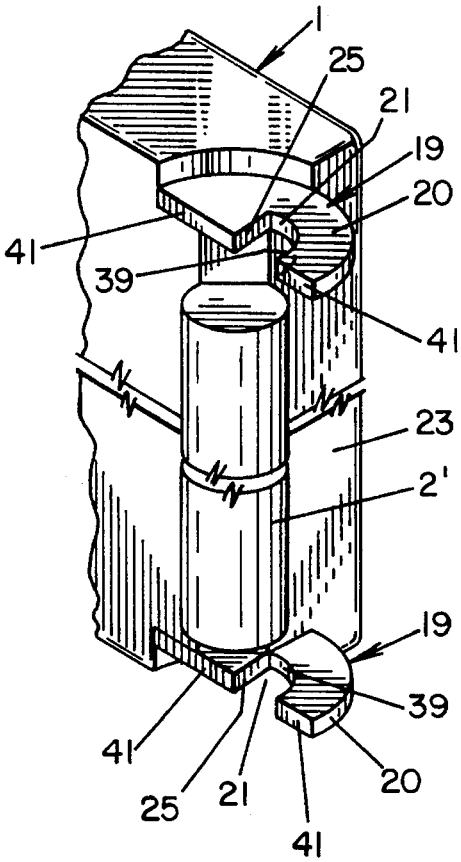
FIG. 13 is a perspective elevational view showing the hinge element and hinge rod mounted on a door.
Figure 15:
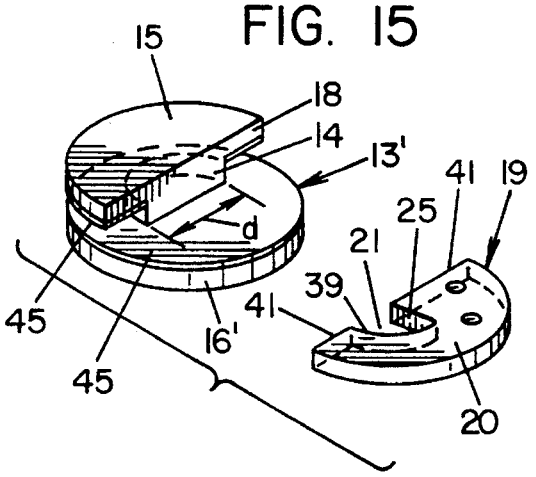
FIG. 15 is an exploded perspective view of the second embodiment of a hinge interlock.

Each hinge unit contains interlock means 42 comprising at least one hinge pick-up 6, 6' mounted in the cabinet and hinge element 7, 7' mounted in the door. With the door closed (FIG. 5A) the hinge element engages the corresponding pick-up in axial alignment with the hinge rod 2, 2'. Preferably each hinge unit contains two such interlocks located in the upper and lower area of the hinge rod 2 as noted in FIG. 6. With the door opened as seen in FIG. 5B, the hinge element 7 is rotated within the pick-up 6, 6' whereby the hinge element is no longer in alignment with inlet 10. The opening movement of the door 1 is arrested when the side edge 23 of the door comes into contract with the front edge 24 of the cabinet. Referring to FIG. 9, the hinge pick-up 6 is shaped like a cylindrical section closed at the bottom by surface 8, and open on top. The cylindrical wall 9 is provided with an inlet 10, the symmetrical axis of which is pointed vertically to the front of the door section. Furthermore, the center axis of the hinge pick-up 6 is aligned with the center axis of the axle take-up 5, 5'. Thus the hinge element 7 is inserted into the hinge pick-up 6 when closing the door 1, as noted in FIGS. 5A and 8 and provides a positive locking when the door 1 is opened from the other side as seen in FIG. 5B.

In order to center the door 1 while closing, the front surfaces 11 of the inlet 10 through the wall 9 preferably taper toward the inside of the cylindrical section at a preset angle. For vertical adjustment of the door 1 in opened and closed condition each pair of hinge pick-ups 6 in the upper and lower area of the door section are arranged in such a way that their openings 38 are facing one another and the center axes are aligned with one another.

Figure 7:
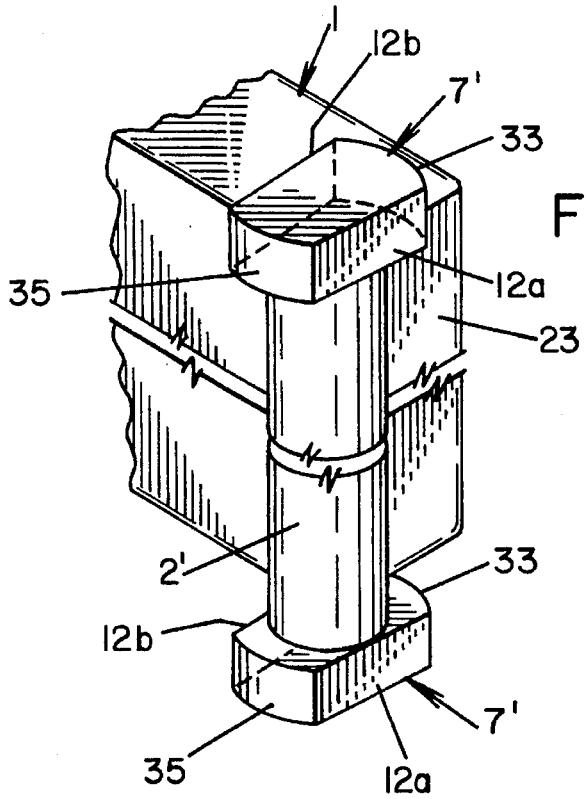
FIG. 7 is a perspective view of a door with a hinge rod and a portion of the safety interlock.

The hinge element 7, 7' which serves as a counterpart for the hinge pick-up 6, 6' is fastened by appropriate means at the end of each hinge rod 2, 2' as seen in FIG. 7. The hinge element 7, 7' is shaped in the form of a disk, the exterior of which is aligned in opposite direction of one another in such a symmetrical and straight line that the planar sides 12 enclose the same angle as the front surfaces 11 of the inlet of the hinge pick-up 6. Each element has a cross sectional shape defined by a pair of arcuate surfaces, 33, 35 joined by a pair of planar, preferably slightly converging surfaces 12*a*, 12*b*. The radius of curvature of each arcuate surface approximates, and is preferably equal to the radius of the interior surface 40 of each cylindrical pick-up 6, 6'. This provides for a good closed linkage to the hinge pick-up 6 on one hand and a large-scale distribution of the weight of door 1 on the load bearing surface 8 of the bottom hinge pick-up. In this way, the hinge elements can be inserted into the hinge pickup 6 and pivoted on the bottom surface 8.

With the door closed, each hinge rod is magnetically coupled to the respective receiver in axial alignment with the corresponding interlock means. When one handle is pulled to open the door, the magnetic attraction along the opposite axis is sufficiently strong to prevent disengagement of the hinge rod from the receiver until the hinge interlock is activated. This action occurs immediately as the hinge element begins to rotate within the pick-up and the arcuate surfaces 33, 35 of the hinge element contacts and becomes mechanically coupled to the inner surface 40 of cylindrical wall 9. The hinge element and pick-up remain interlocked while the door is opened until the door is once again closed.

A second embodiment of this invention is illustrated in FIGS. 10 through 14 showing a safety interlock 44 where the hinge pick-ups 13 consist of two circular disks 15, 16, which are aligned to one another and with one another via center axis 14 whereas one of the disks 15 is shaped as a semicircular disk. These hinge pick-ups 13 are each permanently fitted into a semi-cylindrical shaped recess 17 in the door frame 4 whereas its center axis is aligned with the center axis of the axle take-up 5, 5'. The front 18 of the semi-circular disk 15 is straight and conforms with the front edge of the semi-cylindrically shaped recess 17. The closed circular disk 16 of the upper hinge pick-up 13 is located on top and the closed circular disk 16' of the lower hinge pick-up 13' is located on the bottom of the hinge. With this variation, an equally good guidance of the door is achieved, as described above. Furthermore, this provides for the door 1 to be uniformly closed and evenly aligned with the door section.

The hinge element 19 consists of a semicircular disk 20 with a semi-circular centering recess 21, the diameter of which corresponds to the outer diameter of the center axle or post 14 of the hinge pick-up 13. The space between the disks 15, 16 of each hinge pick-up 13 should correspond to the thickness of the semi-circular disk 20 in order to achieve a guidance free from play. Furthermore, the facing sides 45 of the disks 15, 16' provide the guide surfaces 22 for the upper and lower hinge pick-up 13, 13' in order to pick-up the hinge elements 19. These facing sides preferably comprise a low friction surface, such as Teflon, to permit the hinge element 19 to glide smoothly between discs 15, 16. The hinge elements 19 may be attached to door 1 by the use of fasteners 36.

The semi-circular centering recess 21 in the hinge element 19 comprises a straight portion 25 extending into the disc 20 a distance equal to the diameter d of post 14 and a semi-circular portion 39 returning to and terminating at the planar edge 41 of the disc. This provides a recess opening no smaller than the radius of said post. The surface 25 forms an angle of approximately 90° or greater with respect to the planar surface 41 thereby serving, as shown in FIG. 12B, to limit the degree to which door 1 can be opened about the pivot axis. The recess is sufficiently wide to permit rotation of disc 20 about post 14. If the distance of the guide surfaces 21 of the disks 16, 16' of the upper and lower hinge pick-ups 13, 13' corresponds to the height of the door 1 then the door can rotate between the hinge pick-ups 13, 13' in order to achieve an extremely good closed-linkage when the door 1 is closed. Thus, according to this invention, a refrigerator can be produced, which when looking at it can hardly be distinguished from a regular and commonly used refrigerator, but it can be utilized more universally than any of the others.

The above described hinge arrangements for one side of the door 1 are each to be arranged in the manner as illustrated in FIGS. 4 and 12 in order to be able to open the doors 1 from either side. For both embodiments of this invention, the hinge rods 2, 2' which are inserted into the door section will provide protection against the door falling or dropping while being closed. In case the door 1 is to be opened, then it needs to be grabbed and pulled on that particular side, just like with any other refrigerator door. It would be practical in this case if a handle is provided on each side of the door to avoid unnecessary lever action in the lower area of the front door. Immediately while opening the door 1 the door hinge of the other side will begin its function by providing a closed linkage between the hinge pick-up 6, 13 and the appropriate hinge elements 7, 19, enabling the door 1 to be rotated around the axle of the door hinge. This also secures the door 1 from falling or dropping in opened position. In case the door 1 is opened from the other side, then the same action occurs as above only in reverse.

The opening angle of the door 1 can be limited by using the side edges 23 of the door 1 and the front edges 24 of the door frame 4 as stops as seen in FIG. 4. In this case the door can be opened at a maximum angle of 90°. The variation illustrated in FIGS. 12A, 12B shows that stops 25 are provided within the hinge pick-ups 13 which provide for opening angles slightly greater than 90° if desired.

The components of the hinge units are prepared from materials which are suitable for their respective tasks. As previously noted, the hinge rod and receiver are preferably joined to one another by magnetic forces thus defining and limiting the scope of materials useful therefor. The hinge element and pick-up are made from materials such as reinforced polymers and/or metals that will provide sufficient interlocking strength to resist fracturing and wear while at the same time permitting repetitious rotation of the element within the pick-up. The hinge components are incorporated into the cabinet and door by appropriate means such as mechanical fasteners or by the use of bonding agents such as adhesives or techniques such as ultrasonic welding for thermoplastic parts or arc welding for conductive metal parts. Alternatively, some of the components may be incorporated into the cabinetry as it is being formed by injection molding, extrusion or the like.

Various modifications can be made in the practice and utilization of this invention without departing from the scope thereof. For example, the component parts of the hinges can be reversed with the hinge rods being mounted in the sides of the cabinet and the receiver being affixed to the two edges of the door. Another modification comprises providing the hinge interlocks with the pick-ups incorporated into the door and the corresponding hinge elements secured to the cabinet.

Furthermore, the number and placement of interlocks along each hinge unit can be varied depending on such factors as the size and the weight of the door. For most applications, two interlocks preferably are used. However, for small 1 or 2 cubic foot refrigerators, one interlock at the bottom, concurrently serving as a weight bearing support for the hinge rod may be adequate. For larger models, the use of three or more interlocks may be beneficial, possibly with two interlocks having the hinge pick-up mounted on the cabinet and the remaining pick-up(s) mounted on the door.

Furthermore, in some installations, the use of a pair of stub axles in place of a full length hinge rod may be adequate to provide the requisite magnetic attraction to permit satisfactory opening and closing of the door.

These and other modifications can be made in the teachings of the present invention without departing from the scope thereof as defined by the claims and their equivalents.

Having thus described the invention it is claimed:

1. A hinge unit for use along one side of a double-hinged door and the frame of a cabinet, said hinge unit comprising:

a) an elongated pivot means, a receiver, and means to magnetically couple said pivot means to said receiver; said pivot means engaging said receiver to form a pivot axis for the hinge unit, the pivot means being rotatable about said pivot axis within said receiver; and b) at least two spaced apart interlocks in axial alignment with said elongated pivot means, each interlock comprising a planar semicircular hinge element adapted to be mounted along one edge of the door, and a pickup engageable by the hinge element, each hinge element having a curved semicircular edge, a straight diametric edge and a semicircular recess communicating with said straight edge, said recess extending into the hinge element on one side of the diametric axis of the hinge element, said pickup comprising a circular disc, a semicircular disc, and a semicylindrical post joining the two discs, while maintaining a space between the discs to receive the hinge element therebetween, the planar hinge element being rotatable into interlocking engagement with said pickup when the hinge element is mounted on the door, said pickup is mounted in the cabinet frame, and said hinged door is rotated about said pivot axis, said hinge element being removable from said pickup upon rotation of said door about a pivot axis through a second hinge unit mounted on a second side of the cabinet frame and said door.

2. The hinge unit according to claim 1, wherein the hinge element is a disc and the semicircular recess comprises a straight surface extending from the axis of the disc in a direction generally at right angles to the straight edge of the disc for a distance at least equal to the radius of the semicircular post, said surface continuing as a curved surface having a radius of curvature comparable to the radius of said post and terminating at the straight edge of the disc to provide an opening to receive said post.

3. The hinge unit according to claim 2, wherein the post includes a planar surface and the straight surface of said recess comprises a stop adapted to contact the planar surface of said post to limit the distance that a door may be opened.

4. A safety interlock adapted to be used on one side of a cabinet frame and a door capable of being pivotally opened from either side of the frame about first and second separate hinge axes, said interlock including: a) at least two hinge pickups in axial alignment with said first hinge axis, each pickup including a circular disc, a semicircular disc having a semicircular edge and a diametric straight edge, and a coplanar semicylindrical post, said semicircular disc joined to but spaced from said circular disc by the post, the straight edges of said semicircular disc and post being in axial alignment with said first hinge axis; and b) a hinge element associated with each pickup and rotatable into interlocking engagement with respect thereto upon opening of said door about said first axis, and wherein the hinge element is separable from the respective hinge pickup when said door is opened about its second hinge axis, said hinge element comprising a semicircular disc having a semicircular edge and a planar diametric edge, said disc containing a recess in communication with said planar edge thereof, said recess facing the planar surface of the semicircular post of the corresponding hinge pickup when the door is closed, said recess adapted to engage the semicircular surface of the post to permit said door to be opened about said first hinge axis whereby the door becomes mechanically coupled to said cabinet when said door is open.

5. The interlock according to claim 4, wherein the recess in said semi-circular disc has a semi-arcuate shape formed by a straight surface extending from the straight edge of the disc at right angles thereto for a distance at least equal to the radius of the semi-circular post, said surface continuing in a circular curve having a radius of curvature comparable to that of said post radius, and terminating at the straight edge of said disc to form an opening no smaller than the radius of said post.

6. The interlock according to claim 5, wherein said straight portion of the recess is adapted to abut the planer surface of said post upon opening of the door about said first hinge axis, thereby limiting the distance that said door can be opened.

7. A cabinet having a frame defining an opening, a generally rectangular hinged door enclosing said opening and including hinged closure means on two opposing sides of said door, the closure means on one side being coupled to the frame of the cabinet when the door is opened from the other side, the improvement wherein each of said closure means comprises:

a) an interlock including at least two hinge elements spaced apart from one another and mounted in axial alignment along a swivel axis of said door, and corresponding hinge pickups mounted in the frame of the cabinet to receive each of said hinge elements when the door is opened about the swivel axis passing through the hinge elements, each hinge element in the shape of a semicircular disc having a semicircular edge and a planar diametric edge, the disc having a recess on one side of the axis intersecting the planar diametric edge and in communication therewith, each hinge pickup comprising two discs, a circular disc, and a semicircular disc having a planar edge; the two discs joined together by a semicircular post having a planar surface, the discs of each pickup being spaced from one another a distance sufficient to receive the semicircular hinge element therebetween; and, b) a hinge rod between and axially aligned with said hinge elements mounted along one side of said door, a semicircular receiver integral with the cabinet frame, and magnetic coupling means whereby said hinge rod is magnetically engaged with the corresponding receiver to retain the door on the cabinet when closed, the planar surface of said post and the planar edge of the semicircular disc of the pickup being coplanar with the opening of said semicircular receiver.

8. The cabinet according to claim 1, wherein the recess in the semicircular disc of each hinge element has a semiarcuate shape formed by a straight surface extending from the planar diametric edge of the disc at right angles thereto for a distance at least equal to the radius of the semicircular post, said surface continuing in a circular curve having a radius of curvature comparable to that of said post radius, and terminating at the planar edge of said disc to form an opening no smaller than the radius of said post.

9. The cabinet according to claim 8, wherein said straight portion of the recess is adapted to abut the planar surface of said post upon opening of the door about said first hinge axis, thereby limiting the distance that said door can be opened.

* * * * *